US005833828A

United States Patent [19]

Gubig

[11] Patent Number: 5,833,828

[45] Date of Patent: Nov. 10, 1998

[54] METHOD AND APPARATUS FOR THERMAL PROCESS CONTROL IN THE ELECTROFORMING OF STAMPERS FOR PRODUCTION OF CD/LD DATA CARRIERS

[75] Inventor: Andreas Gubig, Gütersloh, Germany

[73] Assignee: Technotrans GmbH, Sassenberg, Germany

[21] Appl. No.: 783,452

[22] Filed: Jan. 16, 1997

[30] Foreign Application Priority Data

Jan. 23, 1996 [DE] Germany ..... 196 02 182.0

[51] Int. Cl.[6] ..... C25D 1/00

[52] U.S. Cl. ..... 205/68; 205/82; 205/83; 205/137; 204/212; 204/238; 204/264; 204/273

[58] Field of Search ..... 205/68, 82, 83, 205/137; 204/212, 238, 264, 273

[56] References Cited

U.S. PATENT DOCUMENTS

| | | | |
|---|---|---|---|
| 4,415,423 | 11/1983 | Brooks | 205/68 |
| 4,539,079 | 9/1985 | Okabayashi | 205/68 |
| 5,244,563 | 9/1993 | Langenskiöld et al. | 205/68 |
| 5,597,460 | 1/1997 | Reynolds | 204/212 |

OTHER PUBLICATIONS

Galyanoformung bei der Herstellung von Bildplatten; ProzeBuberwachung von Nickelsulfamatelektrolyten; pp. 61–63, Galvanotechnik 77(1986) No. 1. no month available. Hochgeschwindigkeitsgalvanoformung fur optische Speicherplattenmatrizen; Von Peter E.J. Legierse und Roel van Dam, NL 5600 AV Eindhoven pp. 787–794, Galvanotechnik 84(1993) No. 3. no month available.

Hertstellung optischer Kimponenten durch Galvanoformung Von Drs. J.H.A. Schmitz und M.A.F. v. Hoek, NL–5600 MD Eindhoven pp. 385–390. no date available.

Patent Abstracts of Japan; C–905 Jan. 28, 1992 vol. 16/No. 33; Electrocasting Device; 3–243785(A) Canon Inc (72) Takayoshi Tsutsumi.

*Primary Examiner*—Kathryn L. Gorgos
*Assistant Examiner*—Kishor Mayekar
*Attorney, Agent, or Firm*—Griffin, Butler, Whisenhunt & Szipl, LLP

[57] ABSTRACT

A method and an apparatus for thermal process control in electroforming stampers for the production of CD/LD data carriers or the like. The temperature of an electrolytic solution in an electroforming cell is maintained at a value nearest a specific maximum temperature by raising or lowering the temperature of the electrolytic solution in a storage tank provided outside of the electroforming cell as a function of the temperature measured in a cathode space of the electroforming cell. A temperature sensor is disposed in or near the cathode space adjacent an electrolyte injection nozzle in a space between the anode and cathode means for supplying signals to a control unit. The temperature sensor and the injection nozzle are preferably assembled into a single mounting unit. The electroforming process can thus be run with an optimum effectivity in the vicinity of a maximum permissible temperature of the electrolytic solution.

5 Claims, 2 Drawing Sheets

METHOD AND APPARATUS FOR THERMAL PROCESS CONTROL IN THE ELECTROFORMING OF STAMPERS FOR PRODUCTION OF CD/LD DATA CARRIERS

BACKGROUND OF THE INVENTION

The invention relates to a method and an apparatus for thermal process control in the electroforming of stampers for the production of compact disc/laser disc (CD/LD) data carriers.

The production of stampers or pressing moulds for the fabrication of data carriers such as compact discs, video discs, CD-ROMs and other digital or analog signal data carriers by injection molding is done electrolytically by depositing a suitable metal such as Ni on a master piece in an electroforming cell comprising an anode basket and a cathode plate arranged parallel spaced to each other. The anode basket is electrically connected to the positive pole and the cathode plate to the negative pole of a DC power source. An electrolytic solution in a storage tank outside of the electroforming cell is first controlled to a suitable more or less empirically determined certain temperature and then introduced from the storage tank into the electroforming cell and thereafter when passed through the electroforming cell returned to the storage tank. A typical measure in the prior electroforming processes is in the control of the temperature of the electrolyte in the storage tank on an essentially empiric basis as it is disclosed e.g. in "Galvanotechnik" 77 (1986) No. 1 pages 61–63, JP-A-3/243785, and "Galvanotechnik" 84 (1993) No. 3, pages 787–794.

It has been found that with increasing temperature of the electrolytic solution the amperage can be increased resulting in higher deposition rates and thus a shortening of the deposition time necessary to achieve an adequate plating thickness. The temperature of the electrolytic solution, however, must not exceed an upper limit, since overheating the electrolyte may cause the formation of detrimental gases, e.g. ammoniac, which would very quickly lead to an irreversible change in the electrolyte which then becomes useless. The conventional manner of control of the temperature of the electrolytic solution in the storage tank on an empiric basis thus needs to take into account a suitable safety spacing from an optimum temperature of the specific electrolyte, namely by the reason that the electrolytic process is an exothermic process so that heat is introduced into the electrolytic solution during operation, thereby the temperature of the electrolytic solution in the electroforming cell, particularly in the critical region between the anode basket and the cathode plate, may substantially deviate from the temperature of the electrolyte in the storage tank. In order to assure that in any case the electrolytic solution is prevented from being overheated in the electroforming cell, the temperature of the electrolyte in the storage tank is held far below a maximum permissible temperature with respect to a high safety spacing as established empirically. This often results, however, in the temperature of the electrolytic solution in the electroforming cell becoming too low which not only reduces the effectivity of the electroforming process, and prolonges the electrolytic treatment time, but also affects the quality of the electrolytic deposition or plating, namely its thickness and thickness distribution.

A main object of the present invention is to provide a method and apparatus of the before-mentioned type which enable optimizing the electroforming process as regards the influence of the temperature of the electrolyte on the process. Another object is to relieve the electroforming process from establishing empiric values of a suitable temperature of the electrolyte used in the process.

SUMMARY OF THE INVENTION

These objects are achieved in accordance with the present invention by a method for thermal process control in a process of electrolytic forming stampers for the production of CD/LD data carriers by an exothermic electrolytic reaction, in which an electrolytic solution controlled to a temperature below a specific temperature in a storage tank is supplied to an electroforming cell in which a region divided into an anode space and a cathode space is defined between anode and cathode means, and is returned to the storage tank after having passed through the electroforming cell, said method comprising the steps of: sensing the temperature of the electrolytic solution in or near the cathode space of the electroforming cell, and controlling one or more of the following parameters: the flow rate of the electrolytic solution through said electroforming cell, the temperature of the electrolytic solution in said storage tank, and an electrical current flowing between said cathode and anode means, in response to the temperature of the electrolyte measured in or near the cathode space whereby the temperature of the electrolyte in the cathode space is maintained at a level in the vicinity of or equal to said specific temperature.

The apparatus according to the invention for thermal process control in a process for electrolytical forming stampers for the production of CD/LD data carriers by an exothermic electrolytic reaction, comprising a tank for storing an electrolytic solution therein, an electroforming cell in fluid communication with said storage tank, a region of the electroforming cell between an anode and cathode means provided in the electroforming cell being divided into an anode space and a cathode space, and means for raising or lowering the temperature of the electrolytic solution in said storage tank, said apparatus further comprising means for sensing the temperature of the electrolytic solution in or near the cathode space of the electroforming cell, and for outputting a signal responsive of the temperature sensed to a control unit for controlling one or more of the following means: means for controlling the flow rate of the electrolytic solution through said electroforming cell, the means for raising and lowering the temperature of the electrolyte in said storage tank, and power control means for controlling the electrical current flowing between said cathode means and said anode means, in response to the temperature of the electrolytic solution measured in or near said cathode space whereby the temperature of the electrolytic solution in the cathode space is maintained in the vicinity of or equal to a specific temperature.

It has been found that the hitherto existing problems in the definition of an adequate value of the temperature of the electrolytic solution which is to be introduced into the electroforming cell can be overcome in a surprisingly uncomplicated and effective manner when the temperature of the electrolytic solution in the storage tank is controlled depending on the temperature of the electrolyte in the vicinity of the cathode means. Thereby the temperature of the electrolytic solution in the storage tank will be permanently maintained at a value suitable that the temperature of the electrolyte in the critical cathode space is kept at an optimum, i.e. near to the upper temperature limit for the specific electrolyte, without a risk of overheating the electrolyte. Optimizing the electroforming process according to the invention can readily be achieved at a relatively low apparative expense since substantially merely installing a temperature sensor in or adjacent the cathode space and a suitable control means for processing the signals output by the temperature sensor are required to control one or more of the means which effect the temperature of the electrolyte in the electroforming cell. Significant improvements in the yield and the quality of the products resulting of the method can be achieved, in particular stampers made in accordance with the present invention may have a preferred thickness and an excellent thickness distribution of the plating.

BRIEF DESCRIPTION OF THE DRAWINGS

The invention will now be described in more detail with reference to a preferred embodiment thereof and the drawings in which.

DESCRIPTION OF THE PREFERRED EMBODIMENT(S)

Figure 1:
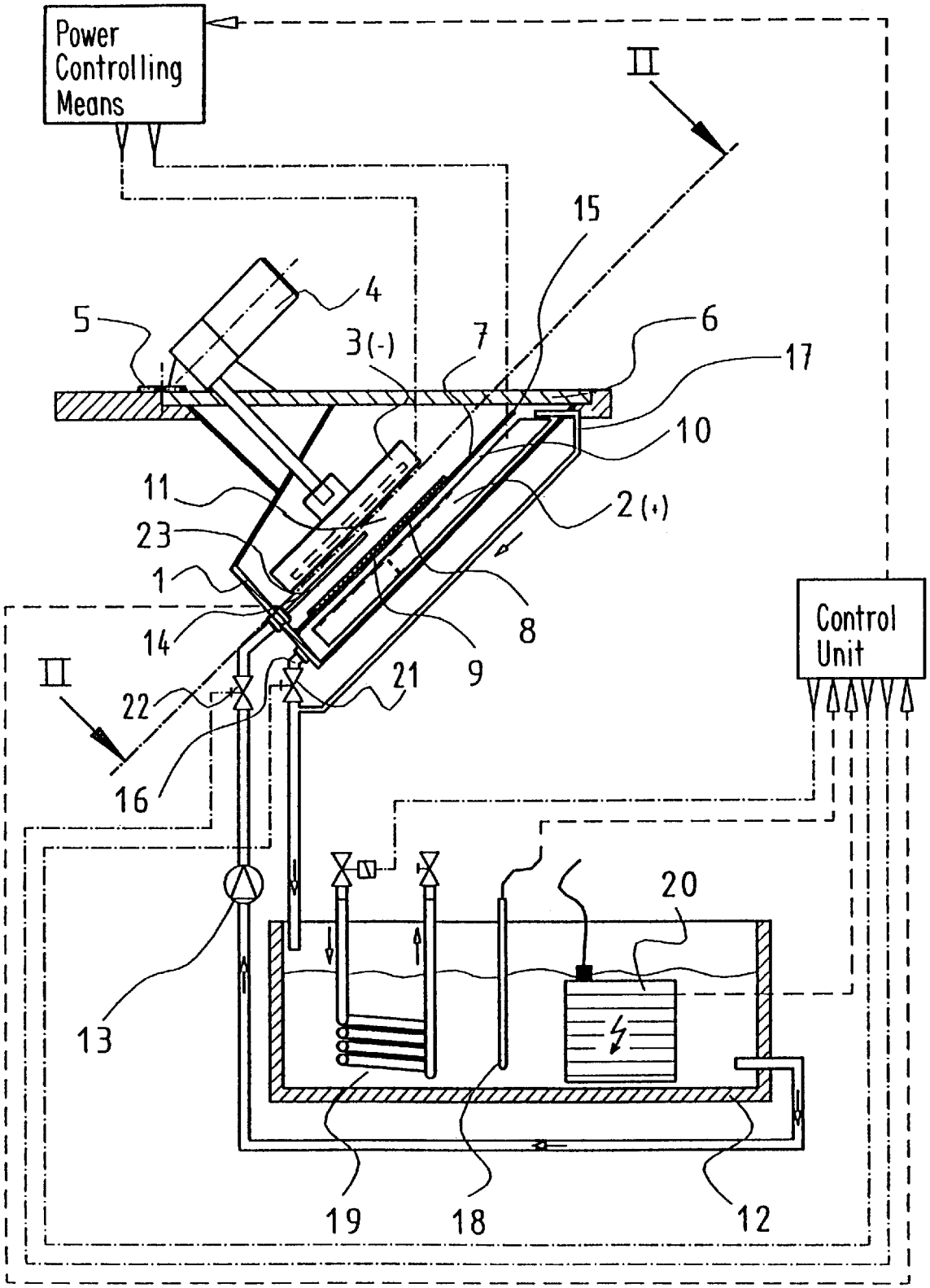
FIG. 1 is a schematic sectional view of an electroforming apparatus in accordance with the present invention.
Figure 2:
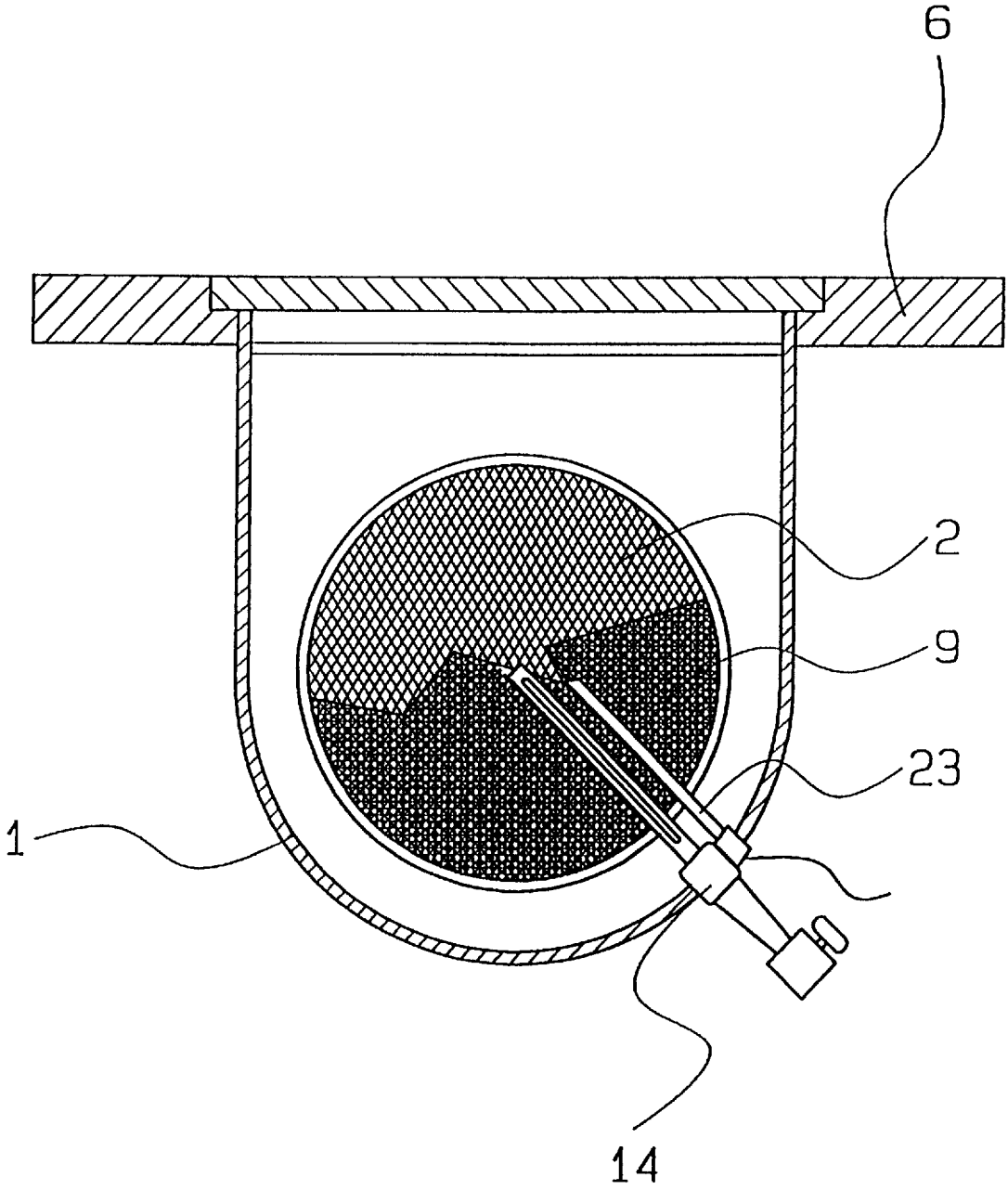
FIG. 2 is a sectional view along the line II—II of the electroforming apparatus as shown in FIG. 1.

Reference numeral 1 in FIGS. 1 and 2 denotes the housing of an electroforming cell mounted to a lid 6 which, as shown by numeral 5, is hinged to a machine frame. Accordingly, the housing 1 can be pivoted together with the lid 6 between an operating position shown in FIG. 1 and a service position the lid takes up when turned counter-clockwise. In the electroforming cell an anode basket 2 is arranged which is preferably made of titanium. Mounted parallel spaced from the anode basket 2 is a cathode plate 3 in the electroforming cell, which is rotatable about an axis. A drive means 4 is provided to rotate the cathode plate 3 at a desired rotary speed. The anode basket 2 can be filled with Ni when the plating of a stamper mounted to the cathode plate 3—indicated dashed in the drawing—is to be made with Ni. Other suitable metals like gold can be used, if desired.

The cathode plate 3 is connected to the negative pole of a DC power source, the positive pole of which is connected to the anode basket 2 so that in the ON condition of the DC power source a current flows between the anode basket 2 and the cathode plate 3, the amperage of which can be adjusted.

In the space of the electroforming cell between the anode basket 2 and the cathode plate 3 a partition 7 is provided which divides the housing 1 into an anode space 10 containing the anode basket 2 and a cathode space 11 containing the cathode plate 3. In the partition 7 an opening 8 adapted to the size of the cathode plate 3 is provided which may be covered by a diaphragm 9. The structure of the diaphragm 9 is such that it is permeable for the metal ions liberated by the electroforming process so that they are able to move from the anode basket 2 through the diaphragm 9 to the cathode plate 3, whereas any dirt particles present are held back and retained in the anode space 10.

Outside of the housing 1 a tank 12 for storing a suitable quantity of electrolytic solution is arranged. A pump 13 in a conduit porting into the storage tank 12 in the vicinity of the bottom thereof supplies the electrolytic solution from the storage tank 12 via an input flow control valve 22 into the electroforming cell, more particularly into the cathode space 11. The electrolytic solution flows along the partition 7 to an upper overflow edge 15 and gains access from there to the anode space 10. At the lowest portion of the electroforming cell the electrolytic solution leaves it and is returned therefrom via a return flow control valve 21 in a return conduit to the storage tank 12. A bypass conduit 17 is provided to drain excess electrolytic solution from the anode space 10 having collected above the overflow edge 15 of the partition 7 and to return it to the storage tank 12.

For raising or lowering the temperature of the electrolytic solution in the storage tank 12 suitable means, e.g. in the form of an electrical heating means 20 and a cooling means 19, both immersed in the electrolytic solution of the storage tank 12 are provided. The aforementioned basic structure of an electroforming apparatus is known and thus requires no further explanation in this context.

A temperature sensor 18, e.g. a thermocouple can be arranged in the storage tank 12 to sense the temperature of the electrolytic solution in the storage tank 12 and to furnish a signal responsive to this temperature to a control unit for controlling the operation of the heating means 20 or the cooling means 19.

In accordance with the present invention a further temperature sensor 23 is provided which is shown in FIG. 2, whilst in FIG. 1 it is covered by an injection nozzle 14 to be subsequently described in more detail. If desired the temperature sensor 18 immersed in the electrolytic solution of the storage tank 12 can be omitted.

The temperature sensor 23 serves for sensing the temperature of the electrolytic solution in the electroforming cell and to furnish a signal responsive to this temperature to the control unit. In particular the temperature sensor 23 is disposed at a location where it can measure the temperature of the electrolytic solution in the cathode space 11, i.e. in the vicinity of the cathode plate 3. It has been found that measurement of the temperature at this particular location is important for optimizing the electroforming process. It is further preferred that the temperature sensor 23 is arranged at a location at which no effects capable of falsifying the results of the measurement on the side of the injection nozzle 14 extending into the cathode space 11 are to be feared. Namely the temperature sensor 23 should be axially set back by a suitable distant from the orifice of the injection nozzle 14 in order to prevent the jet of electrolyte output from the injection nozzle 14 from directly effecting the sensor 23.

It is further preferred that the injection nozzle 14 and the temperature sensor 23 form a single unit to permit insertion into an opening of the housing 1 for securing therein to facilitate installation.

In response to the signal output by the temperature sensor 23, which is characteristic for a temperature of the electrolyte existing in the cathode space 11, the control unit furnishes signals for actuating one or both flow control valves 22 or 21 for the supply and discharge of the electrolytic solution to/from the electroforming cell for controlling the flow rate of electrolytic solution through the electroforming cell in accordance with the temperatures measured in the cathode space 11, or the heating means 20 or cooling means 19 for raising or lowering the temperature of the electrolytic solution in the storage tank 12 to a suitable value which no longer needs to be limited by an empiric safety spacing far below a maximum value, or a DC power source or control means for controlling the current flowing between the anode basket 2 and the cathode plate 3, thereby the possible influence of the current on the temperature of the electrolytic solution in the electroforming cell. These measures enable the temperature of the electrolytic solution in the electroforming cell to be maintained at an optimum value near an upper permissible limit.

Instead of actuating one of the above-mentioned temperature influencing means of the apparatus only, two or more such means could be actuated at a time or one after another.

In the case of the preferred use of a Ni electrolyte the permissible upper temperature limit at which no ammonia is formed is approx. 65° C. The control unit is designed to keep the temperature of the Ni electrolyte in the cathode space nearest this upper temperature limit so that work can be done with maximized amperages to minimize the duration of the electroforming process.

Whereas a preferred embodiment of the invention has been shown and described, it will be realized that modifications and alterations of the embodiment can be made without departing from the scope of the invention.

What is claimed is:

1. A method for thermal process control in a process of electrolytical forming stampers for the production of compact discs/laser discs (DC/LD) data carriers by an exothermic electrolytic reaction, in which an electrolytic solution which is controlled to have a temperature below a specific temperature in a storage tank is supplied therefrom to an electroforming cell with anode and cathode means provided therein, a region between said anode and cathode means being divided into an anode space and a cathode space, and is returned to the storage tank after having passed through the electroforming cell, comprising the steps of: sensing the temperature of the electrolytic solution in or near the cathode space of the electroforming cell, and controlling one or more of the following parameters: the flow rate of the electrolytic solution through said electroforming cell, the temperature of the electrolytic solution in said storage tank, and an electrical current flowing between said cathode and anode means, in response to the temperature sensed in or near the cathode space for maintaining the temperature of the electrolytic solution in the cathode space at a level in the vicinity of or equal to said specific temperature.

2. The method as set forth in claim 1, wherein said electrolytic solution comprises Ni ions, and wherein said specific temperature of said electrolytic solution is about 65° C.

3. An apparatus for thermal process control in a process for electrolytically forming stampers for the production of compact disc/laser disc (CD/LD) data carriers by an exothermic electrolytic reaction, comprising a tank for storing an electrolytic solution therein, an electroforming cell in fluid communication with said storage tank, in which a region of the electroforming cell between an anode means and a cathode means is divided into an anode space and a cathode space, and means for raising or lowering a temperature of the electrolytic solution in said storage tank, and further comprising means for sensing the temperature of the electrolytic solution near or in said cathode space of the electroforming cell and for outputting a signal responsive to said temperature sensed to a control unit for controlling one or more of the following parameters: means for controlling a flow rate of the electrolytic solution through said electroforming cell, said means for raising or lowering the temperature of the electrolytic solution in the storage tank, and power control means for controlling an electrical current flowing between said cathode means and anode means, in response to said means for sensing the temperature of the electrolytic solution in or near said cathode space whereby the temperature of the electrolytic solution in the cathode space is maintained in the vicinity of or equal to a specific temperature.

4. The apparatus as set forth in claim 3, wherein said temperature sensing means is disposed adjacent an injection nozzle disposed in said electroforming cell for ejecting the electrolytic solution into the space between said anode and cathode means.

5. The apparatus as set forth in claim 4, wherein said temperature sensing means and said injection nozzle are assembled to a mounting unit.

* * * * *